US005517164A

United States Patent [19]

Zoller et al.

[11] Patent Number: 5,517,164

[45] Date of Patent: May 14, 1996

[54] MOLDED CASE CIRCUIT BREAKER HAVING MOVABLE CONTACT FINGER RELEASABLY LOCKED TO AN OPERATING MECHANISM

[75] Inventors: Walter M. Zoller, Milwaukee; Donald A. Link, Hubertus; Michael R. Larsen; David S. Hunter, both of Milwaukee; Edward L. Wellner, Colgate; Peter J. Theisen, West Bend, all of Wis.

[73] Assignee: Eaton Corporation, Cleveland, Ohio

[21] Appl. No.: 491,772

[22] Filed: Jun. 19, 1995

[51] Int. Cl.[6] ..... H01H 75/00

[52] U.S. Cl. ..... 335/16; 335/147; 218/22; 218/27

[58] Field of Search ..... 335/16, 147, 195; 218/22, 24, 27

[56] References Cited

U.S. PATENT DOCUMENTS 3,505,622 4/1970 Strobel ..... 335/16

3,559,119 1/1971 Koennecke et al. ..... 335/147

5,430,420 7/1995 Maier ..... 335/16

*Primary Examiner*—Lincoln Donovan

*Attorney, Agent, or Firm*—L. G. Vande Zande

[57] ABSTRACT

A subframe is coaxially pivotally mounted with a movable frame of the operating mechanism of a molded case circuit breaker and is locked to the frame by a bell crank pawl which is pivotally mounted on the subframe. A leaf spring assembly rigidly attached to the subframe overlies the movable contact finger to engage the same in the circuit ON condition of the circuit breaker to provide desired contact force. The bell crank pawl is released upon an incrementally small amount of initial movement of the movable contact arm in response to blow-open magnetic repulsion forces to release the movable contact finger for pivotal opening movement relative to the movable frame of the circuit breaker operating mechanism.

16 Claims, 4 Drawing Sheets

MOLDED CASE CIRCUIT BREAKER HAVING MOVABLE CONTACT FINGER RELEASABLY LOCKED TO AN OPERATING MECHANISM

BACKGROUND OF THE INVENTION

This invention relates to molded case circuit breakers operable in response to fault currents to open the contact and interrupt a circuit in which the circuit breaker is connected. More particularly, this invention relates to circuit breakers of the aforementioned type which are operable upon high fault currents to limit the peak let-through current, commonly known as current limiting circuit breakers. In current limiting circuit breakers, the movable contact must be capable of moving relative to the operating mechanism such that the magnetic repulsion forces created by high fault currents in the contact area are able to blow the movable contact away from the stationary contact to effect separation independently of operation of the operating mechanism. To permit the relative movement, the movable contact finger is customarily connected to the operating mechanism by a resilient spring connection. The resiliency of such connection renders it difficult to achieve proper contact pressure during the normal operated ON position or engaged position of the circuit breaker contacts.

SUMMARY OF THE INVENTION

This invention provides a molded case circuit breaker having a pivoted movable contact finger which is made electrically conductive with a first conductor mounted in the case of the circuit breaker. An operating mechanism connects a collapsible toggle linkage to the movable contact finger by the releasable locking means of this invention. The operating mechanism includes a movable frame pivotally mounted within the breaker case substantially coaxially with the movable contact finger. A subframe is also pivotally mounted coaxially with the frame and movable contact finger and extends along the movable contact finger, having a portion overlying the contact finger. A bell crank shaped pawl is pivotally mounted on the subframe. One arm of the bell crank shaped pawl has a portion overlying the movable contact finger in proximity to the overlying portion of the subframe. The other arm of the bell crank shaped pawl carries a projection which engages a notch in the movable frame. Biasing means are provided between the subframe and the pawl to bias the projection of the pawl into engagement with the notch of the movable frame, thereby locking the subframe to the movable frame. A leaf spring assembly is rigidly affixed to the subframe to overlie the movable contact finger, engaging the finger near its distal end to apply force on the movable contact finger to achieve the desired contact pressure in the engaged position of the circuit breaker contacts. The pivot of the movable contact finger includes an elongated opening in the finger to afford limited movement of the finger away from the stationary contact upon creation of repelling magnetic forces as a result of high fault currents. These magnetic forces also counteract the contact pressure force and cause limited movement of the movable contact finger against the leaf springs. Such movement of the contact finger away from the stationary contact causes the finger to engage the overlying portion of the bell crank pawl, driving the projection out of the notch and releasing the contact finger and subframe from the movable frame of the circuit breaker operating mechanism, permitting movement of the finger relative to that frame such that the finger may pivot to a contact open position.

The invention and its advantages will become more apparent in the following description of the preferred embodiment when read in conjunction with the accompanying drawings.

DETAILED DESCRIPTION OF THE PREFERRED EMBODIMENT

Figure 1:
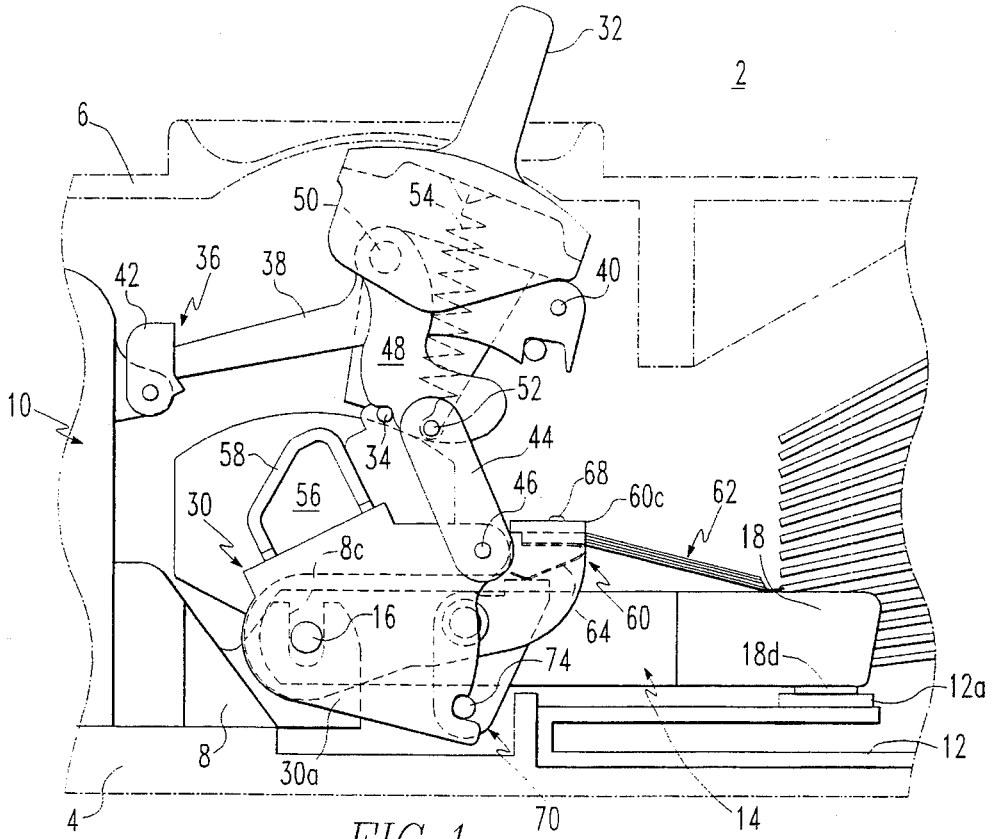
FIG. 1 is a view of the operating mechanism of a molded case circuit breaker, including the contact mechanism and the releasable lock of this invention, with a fragment of the molded case shown in dot-dash lines.

Referring to FIG. 1, the molded case circuit breaker 2 in which the movable contact finger lock of this invention is embodied comprises a molded insulating base 4 and a molded insulating cover 6 shown fragmentarily in dot-dash phantom line. A preformed rigid conductor 8 is mounted to base 4 as seen in the lower left-hand portion of FIG. 1. The conductor 8 extends through a separate removable trip unit assembly 10 to the outside of the breaker for attachment of a wire connecting lug thereto. A stationary contact 12 is mounted to the base 4 as seen in the lower right-hand portion of FIG. 1. Contact 12 is a turn-back contact commonly employed in current limiting circuit breakers to provide a current path of substantial length parallel to the current path in the movable contact finger and directed in an opposite direction to the current path in the movable contact finger. Although a vertically oriented U-shaped stationary contact has been shown, many other configurations of current limiting stationary contacts are known and are equally applicable to the circuit breaker embodying this invention. Stationary contact 12 extends to an exterior end of base 4 for attachment of a wire connecting lug. A contact element **12*a* of high quality circuit making and breaking material is affixed to the stationary contact 12** at one end thereof.

Figure 2:
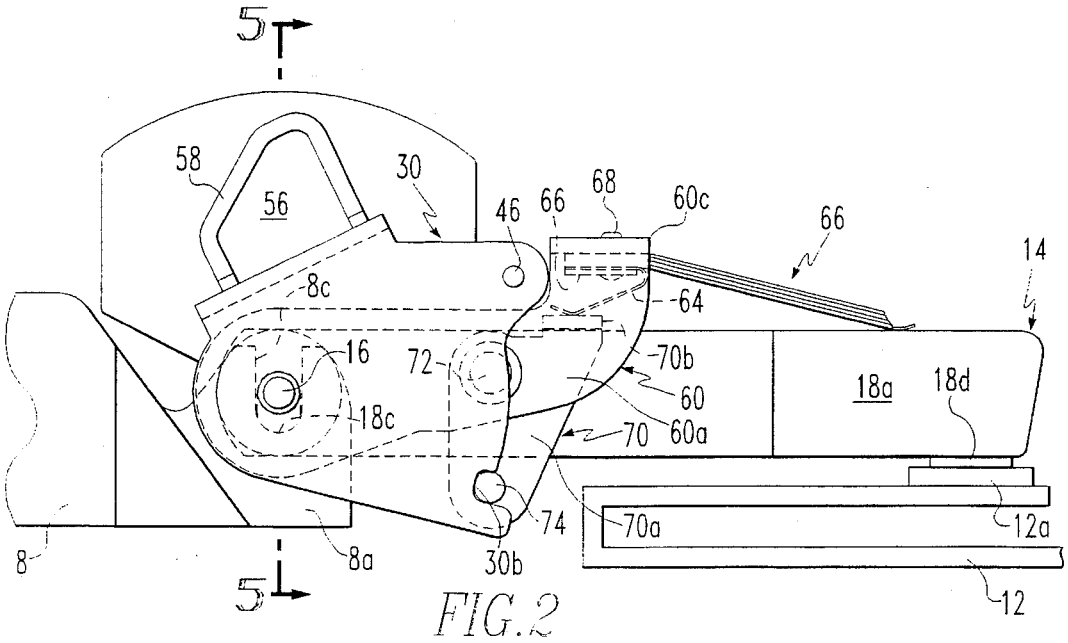
FIG. 2 is a fragmentary view of a portion of the operating mechanism, the contact structure and the releasable lock of this invention.
Figure 5:
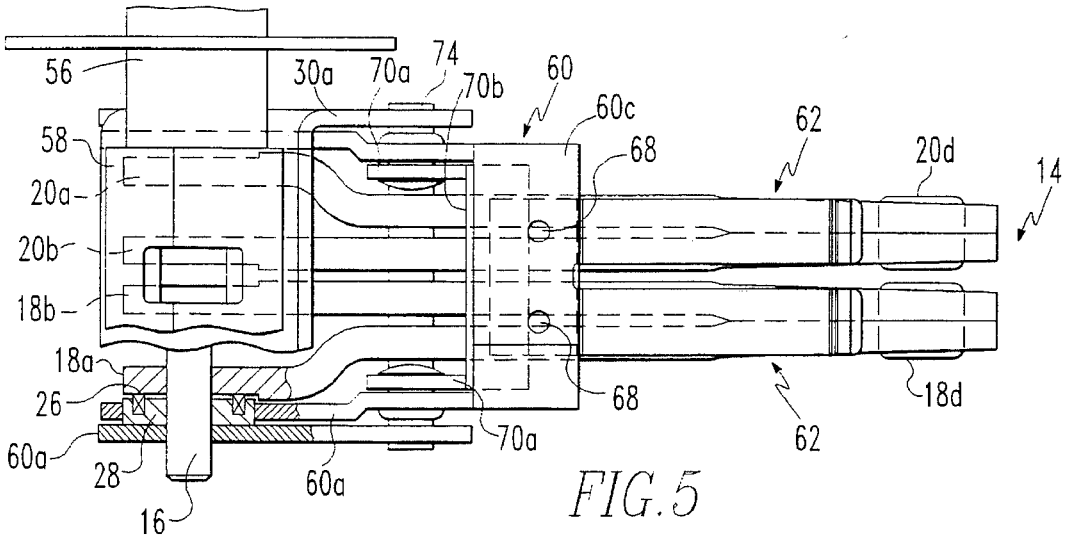
FIG. 5 is a top view of the partial operating mechanism shown in FIGS. 2–4, the movable contact finger assembly and the lock of this invention.
Figure 6:
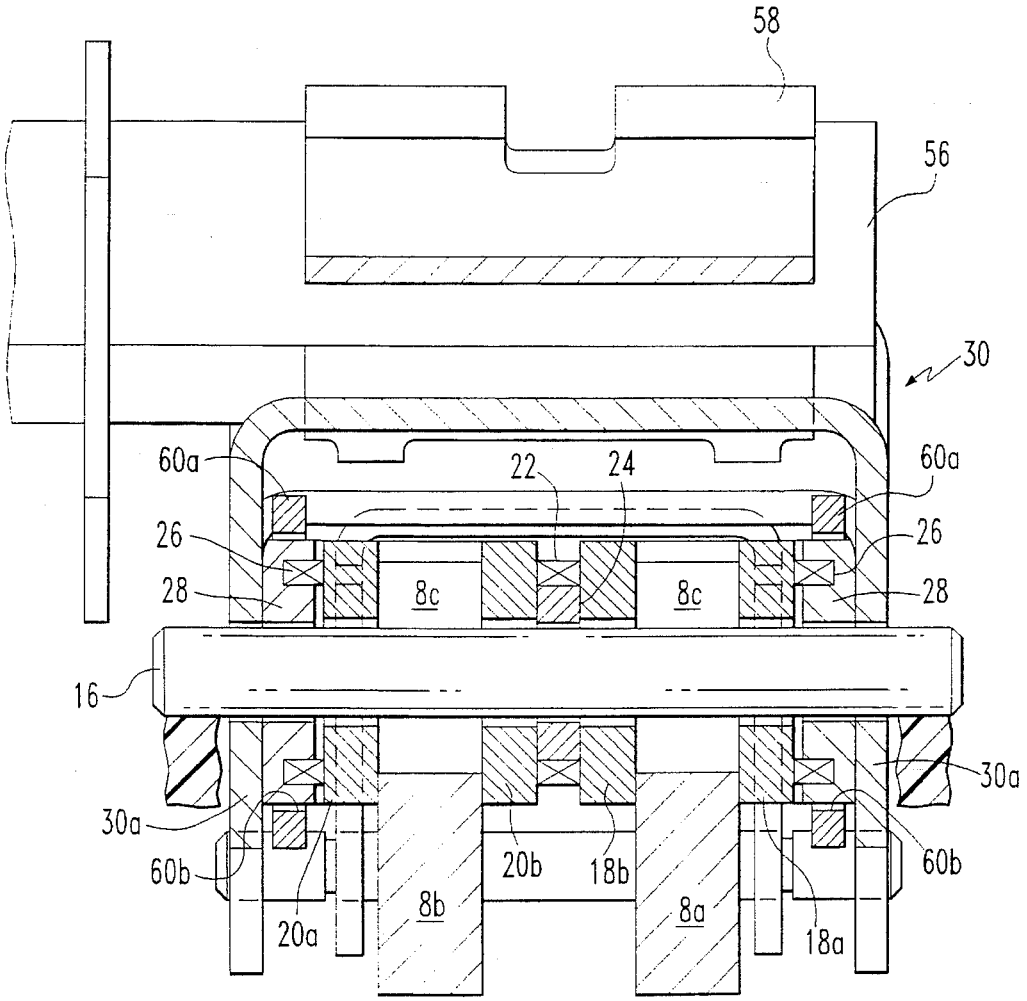
FIG. 6 is a sectional view taken along the line 5—5 in FIG. 2.
Figure 7:
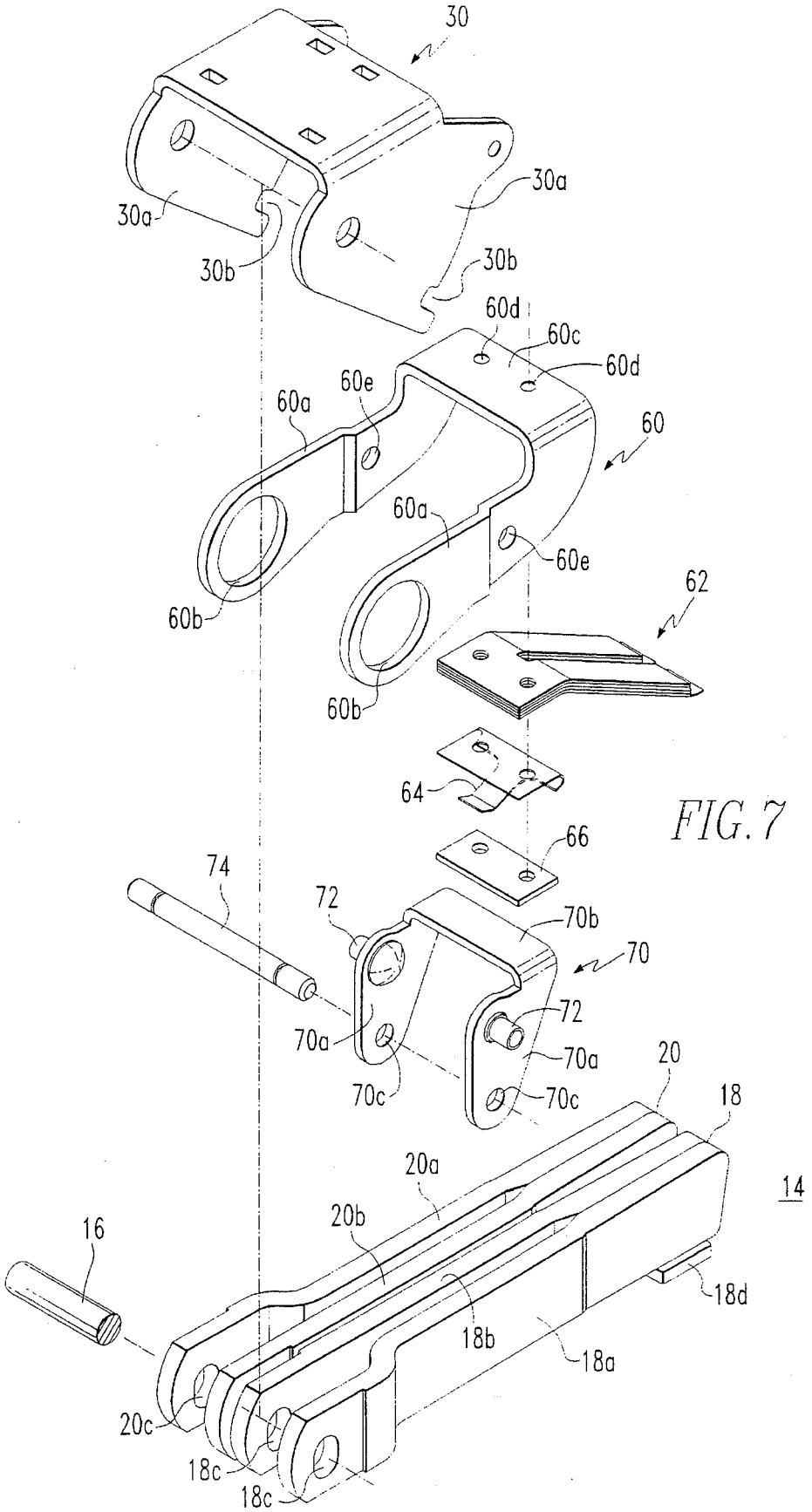
FIG. 7 is an exploded isometric view of the lock of this invention.

A movable contact finger assembly 14 is pivotally mounted in the base 4 of circuit breaker 2 on a pin 16 which is positioned and fixed within the base 4. Referring to FIGS. 5, 6 and 7, it can be seen that movable contact assembly 14 comprises a pair of movable contact fingers 18 and 20, each of which comprise a pair of conductive finger members **18*a*, 18*b* and 20*a*, 20*b*, respectively. The members 18*a*, 18*b* and 20*a*, 20*b* are welded together at one end. The members are shaped for parallel spacing over the central portion of their length and to diverge to a greater spacing at the left-hand ends as viewed in FIG. 7. The left-hand ends of each of the members have aligned openings 18***c*, 20*c*, respectively, the openings being elongated vertically. The welded ends of the movable contact fingers 18 and 20 have contact elements 18*d* and 20*d* affixed to the lower surfaces thereof for engagement with a common stationary contact 12*a*. As seen in FIGS. 1, 2 and 6, conductor 8 has a pair of spaced projections 8*a* and 8*b* oriented vertically and having slots 8*c* open to the top thereof. The left-hand ends of contact finger elements 18*a* and 18*b* are disposed on opposite sides of the projection 8*a*. Similarly, the left-hand ends of movable contact finger elements 20*a* and 20*b* are disposed on opposite sides of projection 8*b* as seen in FIG. 6. A lateral thrust washer 22 is disposed between movable contact finger elements 18*b* and 20*b* at the center of the assembly, positioned by a spacer 24. Similar lateral thrust washers 26 are positioned at the outside surface of contact elements 18*a* and 20*a*, positioned by discs 28. Washers 22 and 26 urge the inner surface of contact fingers 18 and 20 against the respective opposite surfaces of projections 8*a* and 8*b* to form a wiping conductive pivot joint. Alternately, a flexible braided conductor could be connected between conductor 8 and the movable contact finger assembly 14 to make the assembly 14 electrically conductive.

Enlarged openings 60*b* at the ends of a U-shaped subframe 60 are disposed over discs 28, the discs providing a pivot surface for the openings 60*b* of the subframe 60 which will be described in greater detail hereinafter. A U-shaped movable frame 30 is disposed over the contact assembly as seen in FIG. 6 with the outer legs 30*a* being disposed adjacent discs 28. Pin 16 is inserted through aligned holes in the spaced legs 30*a* of frame 30, in discs 28, the spacer 24, the elongated openings 18*c* and 20*c* in the movable contact fingers and in the open slots 8*c* of projections 8*a* and 8*b* of conductor 8. The projecting ends of pin 16 are fixed within molded base 4. Movable contact finger assembly 14, subframe 60 and movable frame 30 are all permitted to pivot coaxially about the axis of pin 16.

An operating mechanism of well known type is provided for the circuit breaker 2. The operating mechanism comprises an operating handle 32 projecting through an opening in cover 6, the handle comprising an insulating molded cap sitting on top of a U-shaped bracket which is pivoted within the case at 34. A latching mechanism 36 comprising an arm 38 pivotally mounted in the case 4 at 40 is held by a latch 42 of the trip unit 10. A collapsible toggle linkage is connected between arm 38 and movable frame 30, a lower end of the lower link 44 being pivotally connected to the frame 30 at 46. The upper end of upper link 48 is pivotally connected to arm 38 at 50. The inner ends of links 44 and 48 are joined by a knee pin 52. Drive springs 54 connect between the knee pin 52 and the bight portion of the handle 32 to provide a resilient driving connection between the handle and the toggle linkage. Movement of the handle 32 to the right-hand position shown in FIG. 1 moves the line of action of drive springs 54 across the pivotal connection 50 of upper toggle link 48 with arm 38, straightening or extending the collapsible toggle linkage to rotate frame 30 clockwise about pin 16 and cause movable contact finger assembly 14 to engage with stationary contact 12. In a known manner, movement of operating handle 32 to a left-hand position moves the line of action of drive springs 54 to the left of the pivotal connection 50, effecting collapse of the toggle linkage and movement of the movable contact finger assembly 14 out of engagement with stationary contact 12. This manual OFF position is well known and has not been illustrated in the drawings. Also in a well known manner, release of latch 42 by trip unit 10 in response to overcurrent conditions effects collapse of the toggle linkage and movement of the movable contact finger out of engagement with stationary contact 12 by permitting the arm 38 to pivot about the pivot point 40, thereby carrying the pivotal connection 50 and the upper end of toggle link 48 to the right of the line of action of the drive springs 54 to effect collapse of the toggle linkage. This trip position is also well known and has not been illustrated in the drawings. In a multi-pole circuit breaker, the operating mechanism is provided in only one pole and additional poles are linked thereto by a cross bar 56 which extends transversely across the additional poles of the circuit breaker and is clamped to each of the movable frames 30 by a clamp 58. In this manner, all of the poles operate simultaneously.

In current limiting circuit breakers, the movable contact finger assembly 14 must be capable of moving independently of the frame 30 of the operating mechanism to permit blow-open of the contacts in response to high fault currents. However, the movable contact finger must also be connected in some manner to the movable frame 30 in order to be operated by the operating mechanism and by the trip unit. This is commonly accomplished by tension springs which join the movable finger to the movable frame. However, known constructions have not always provided satisfactory contact pressure between the movable and stationary contacts in the engaged position. This invention provides a releasable lock between the movable contact assembly and the movable frame which under normal operating conditions provides significant contact force by virtue of a leaf spring assembly bearing upon the movable contact finger.

Referring to FIGS. 1, 2 and 7, an inverted U-shaped subframe 60 (mentioned earlier) has side legs 60*a* having large circular openings 60*b* at the distal ends thereof which are disposed over the discs 28 at the inner surfaces of legs 30*a* of movable frame 30. A common leg 60*c* extends between the side legs 60*a* at the right-hand end thereof and is provided with a pair of holes 60*d*. A multi-leaf leaf spring assembly 62 is attached to the under surface of common leg 60*c* together with a reverse leaf spring 64 and a spring keeper 66 by rivets 68. Leaf spring assembly 62 extends outwardly of subframe 60 to the right to overlie the welded ends of movable contact fingers 18 and 20.

An inverted U-shaped bell crank pawl 70 is pivotally mounted between the legs 60*a* of subframe 60 by a pair of outwardly directed rivets 72 extending through aligned holes in side legs 70*a* of pawl 70 and 60*e* in side legs 60*a* of subframe 60. The common leg 70*b* of pawl 70 joins the side legs 70*a* to the right of the axis for pivoting formed by rivets 72, thereby providing a first lever arm of the bell crank pawl. Side legs 70*a* extend downwardly from the rivets 72 and have holes 70*c* located at the distal ends of the side legs 70*a*, thereby providing the second leg of the bell crank pawl The common arm 70*b* extends across the top side of the movable contact finger assembly 14 below and spaced from the common arm 60*c* of subframe 60. A pin 74 is inserted through the aligned holes 70*c* of pawl 70 to lie just below the bottom surface of movable contact finger assembly 14. Pin 74 is maintained assembled to the pawl 70 by C-clips (not shown) or other suitable fastening means received in annular grooves in the pin 74. Pin 74 projects beyond the outer surfaces of side legs 70*a* and beyond the outer surfaces of side legs 30*a* of movable frame 30. The outer edges of legs 30*a* of movable frame 30 are provided with a notch 30*b* for receiving the projecting ends of pin 74. Leaf spring 64 bears downwardly as oriented in the drawings upon the upper surface of common leg 70*b* of bell crank pawl 70 to bias the pawl clockwise about the pivot 72' biasing pin 74 into engagement with the outer edges of legs 30*a* of movable frame 30. Particularly, spring 64 biases bell crank pawl 70 and its pin 74 into engagement in the notches 30*b* to positively lock subframe 60 to movable frame 30. When so locked and the contact operating mechanism is moved to cause engagement of movable contact finger assembly 14 with stationary contact 12, leaf spring assembly 62 bears firmly against the upper side of movable contact assembly 14 and biases it into engagement with the stationary contact 12, thereby establishing the desired contact pressure between the contact elements. When the operating mechanism is moved to the opposite position to cause the contact to move out of engagement, pin 74 engages the under side of movable contact assembly 14 and rotates it counterclockwise about pin 16 to effect opening under the influence of the toggle linkage.

Figure 3:
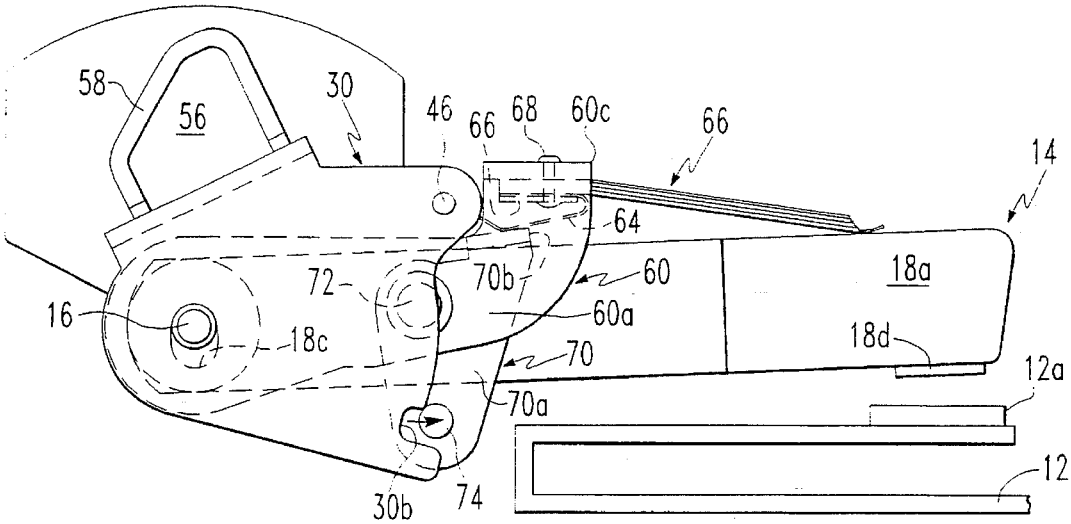
FIG. 3 is a view similar to FIG. 2 but showing release of the lock of this invention upon the occurrence of repelling magnetic forces established by high fault currents.
Figure 4:
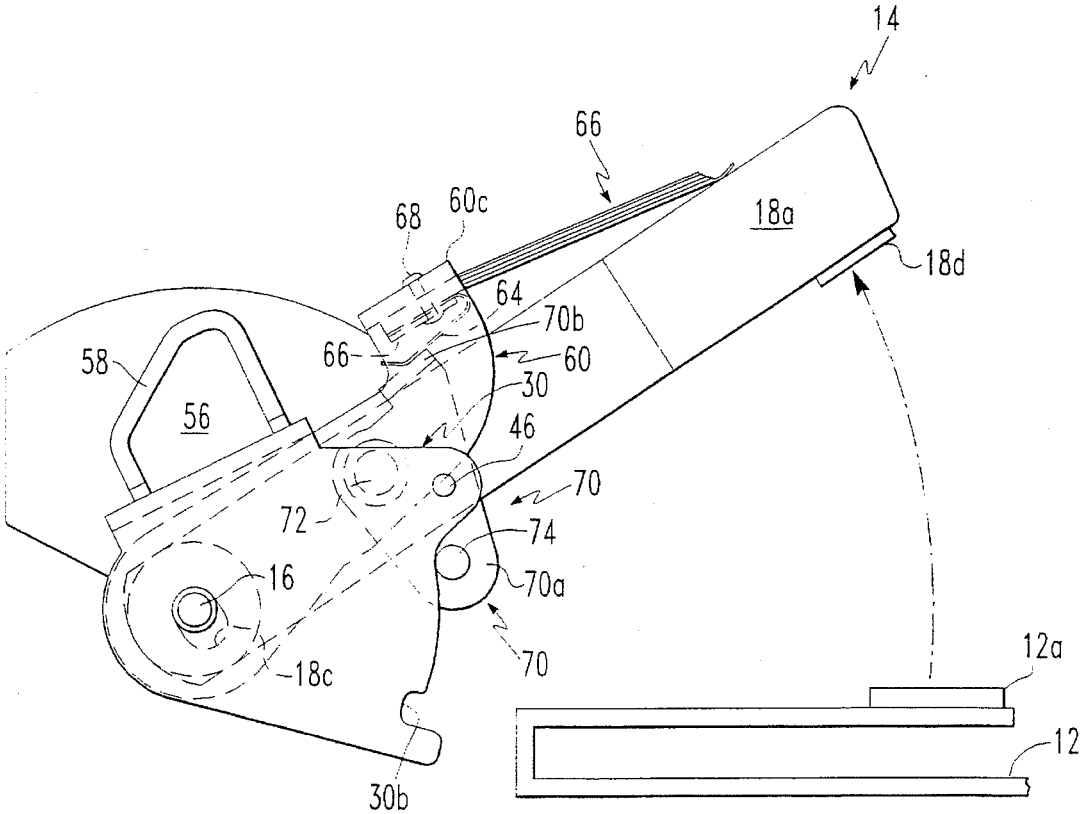
FIG. 4 is a view similar to FIGS. 2 and 3 showing the movable contact finger in the unlocked, full open position.

The contact structure is arranged to be current limiting, i.e. the stationary contact 12 is arranged to have a significant current path extending parallel to the current path of the movable contact finger assembly 14, but in opposite directions. High currents in these paths generate repelling electromagnetic forces which drive the movable contact finger assembly 14 away from the stationary contact 12. When such forces are present, the left-hand end of the movable contact finger assembly 14 at the pivot 16 can move upwardly within the limits of the elongation of the openings 18*c* and 20*c*. Also, the right-hand end of the movable contact finger assembly 14 can move upwardly a limited amount, deflecting the leaf spring assembly 62 slightly. The common leg 70*b* of bell crank pawl 70 is disposed very close to the upper surface of movable contact finger assembly 14 and is immediately engaged by that surface after a small increment of upward movement of the movable contact finger. Such engagement and continued upward movement of the movable contact finger drive bell crank pawl 70 counterclockwise about the pivot 72, moving pin 74 out of notches 30*b* to release the subframe 60 and movable contact finger assembly 14 from the movable frame 30 and the circuit breaker operating mechanism as shown in FIG. 3. When so unlocked, the movable contact finger assembly 14 is free to pivot about pin 16 by virtue of the repelling electromagnetic forces to the contact open position as shown in FIG. 4, while the movable frame 30 and operating mechanism remain stationary in the original ON position until the fault current causes the trip mechanism 10 to trip the breaker open. The movable contact mechanism and its lock can be reset by moving the operating mechanism manually to the OFF position whereupon the movable frame 30 is pivoted counterclockwise about pin 16 to bring the notches 30*b* into alignment with pin 74, causing it and the bell crank pawl to again reengage with the frame 30.

The foregoing describes a preferred embodiment and best mode contemplated of carrying out the invention, providing a lock for positively securing a subframe to a movable frame of a molded case circuit breaker movable contact finger assembly and providing stiff leaf springs on the subframe which bear against the movable contact finger in the ON position of the circuit breaker to provide the desired contact force. The lock is readily released upon the occurrence of magnetic blow-open forces caused by high fault currents to permit the movable contact finger assembly to pivot open independently and relative to the circuit breaker operating mechanism which may remain briefly in its ON position until the trip mechanism trips. Although a single preferred embodiment has been described, it is to be understood that the invention is susceptible of various modifications without departing from the scope of the appended claims.

We claim:

1. In a molded case circuit breaker including:

a molded insulating case having a handle opening;

a stationary contact mounted in said case;

a conductor mounted in said case;

a movable contact finger pivotally mounted in said case for movement into and out of engagement with said stationary contact, said finger being conductively connected to said conductor; and an operating mechanism disposed in said case for moving said movable contact finger into and out of engagement with said stationary contact, said operating mechanism including:

an operating handle pivotally mounted in said case and extending through said handle opening;

a movable frame pivotally mounted in said case;

means connecting said movable contact finger to said movable frame for movement therewith;

a collapsible toggle linkage having one end connected to said frame;

a latching mechanism statically positioning an other end of said toggle linkage in a latched condition of said latching mechanism; and resilient drive means connecting said operating handle and said toggle linkage for manually effecting movement of said movable contact finger with said latching mechanism in said latched condition, said resilient drive means effecting collapse of said toggle linkage in a released condition of said latching mechanism for effecting movement of said movable contact finger out of engagement with said stationary contact;

characterized by said means connecting said movable contact finger to said movable frame comprising:

a subframe pivotally mounted in said case coaxially with said movable frame;

a pawl pivotally mounted on said subframe;

a notch on said movable frame engaged by said pawl for locking said subframe to said movable frame;

means biasing said pawl into engagement with said notch on said movable frame;

spring means carried by said subframe biasing said movable contact finger firmly against said stationary contact in an engaged position of said finger and said stationary contact;

said movable contact finger being movable away from engagement with said stationary contact by repelling magnetic forces generated by high currents in said contactor, said finger engaging said pawl upon initial movement of said finger in response to said magnetic forces, pivoting said pawl against said biasing means for releasing said pawl from said notch, thereby releasing said subframe and said movable contact finger for movement relative to said movable frame and said operating mechanism.

2. The means for connecting a movable contact finger to a movable frame in a molded case circuit breaker defined in claim 1 wherein said movable contact finger is pivotally mounted for rotation substantially coaxially with said movable frame, said finger being afforded movement at said pivotal mount normal to an axis of said pivot and away from said stationary contact, any movement of said movable contact finger away from said stationary contact effecting pivoting of said pawl for releasing said pawl from said notch.

3. The means for connecting a movable contact finger to a movable frame in a molded case circuit breaker defined in claim 1 wherein said pawl comprises an inverted U-shaped bell crank lever straddling said movable contact finger, a common leg of said U-shaped lever disposed across said movable contact finger and spaced from a pivotal axis of said pawl for defining a first arm of said bell crank lever, distal ends of side legs of said U-shaped lever comprising projecting means for engaging said notch, said side legs defining a second arm of said bell crank lever, and said movable contact finger engages said common leg upon movement thereof away from said stationary contact, rotating said projecting means out of said notch.

4. The means for connecting a movable contact finger to a movable frame in a molded case circuit breaker defined in claim 3 wherein said projecting means comprise a pin extending between said side legs across said movable contact finger on an opposite side of said finger from said common leg, said pin abutting said movable contact finger upon operation of said operating mechanism for moving said finger out of engagement with said stationary contact.

5. The means for connecting a movable contact finger to a movable frame in a molded case circuit breaker defined in claim 4 wherein said distal ends of said side legs of said U-shaped bell crank lever comprise holes, and said pin extends through said holes at opposite sides of said lever to comprise said projecting means for engaging said notch.

6. The means for connecting a movable contact finger to a movable frame in a molded case circuit breaker defined in claim 5 wherein said movable frame comprises an inverted U-shaped member, a common leg of said movable frame disposed across said movable contact finger and side legs of said movable frame juxtaposed outwardly of said side legs of said U-shaped bell crank lever, said notch comprising a pair of notches respectively provided in each of said side legs of said movable frame.

7. The means for connecting a movable contact finger to a movable frame in a molded case circuit breaker defined in claim 3 wherein said subframe comprises an inverted U-shaped member straddling said movable contact finger and said bell crank lever, a common leg of said subframe being disposed across said finger and said bell crank lever in spaced overlying relationship to said common leg of said U-shaped bell crank lever, and said means biasing said pawl comprises a spring co-acting between said subframe common leg and said bell crank lever common leg.

8. The means for connecting a movable contact finger to a movable frame in a molded case circuit breaker defined in claim 7 wherein said spring biasing said pawl comprises a leaf spring attached to said common leg of said subframe and bearing against said common leg of said U-shaped bell crank lever.

9. The means for connecting a movable contact finger to a movable frame in a molded case circuit breaker defined in claim 7 wherein said spring means carried by said subframe comprises at least one leaf spring attached to said common leg of said subframe and extending along said movable contact finger, abutting a surface of said finger opposite said stationary contact.

10. Releasable lock means for securing a movable contact finger to an operating mechanism of a molded case circuit breaker comprising:

a movable frame of said operating mechanism mounted for pivotal movement in a molded case of said circuit breaker;

a movable contact finger mounted for pivotal movement in said molded case substantially coaxial with said movable frame, said contact finger having pivot means permitting limited movement normal to an axis of rotation;

a subframe mounted for pivotal movement in said molded case substantially coaxial with said movable frame, said subframe extending along said movable contact finger;

spring means carried by said subframe and engaging said movable contact finger biasing said finger toward an engaged position with a stationary contact of said circuit breaker;

said releasable lock means comprising a pawl pivotally mounted on said subframe and means on said movable frame engaged by said pawl for securing said subframe and said movable frame together for substantially unitary rotational movement of said movable frame, subframe and movable contact finger; and means on said pawl engaged by said movable contact finger upon initial blow-open movement of said contact finger from an engaged position with said stationary contact for releasing said pawl from engagement with said movable frame, thereby affording rotational movement of said subframe and said movable contact finger relative to said frame.

11. The releasable lock means defined in claim 10 wherein said subframe comprises an inverted U-shaped member having a pair of side legs extending along opposite sides of said movable contact finger and a common leg joining said side legs and extending over said movable contact finger spaced from an upper surface of said finger, and said spring means are affixed to said common leg and bear against said upper surface of said movable contact finger.

12. The releasable lock means defined in claim 11 wherein said spring means comprises at least one leaf spring extending along said movable contact finger toward a distal end of said finger.

13. The releasable lock means defined in claim 11 wherein said pawl comprises a bell crank inverted U-shaped member having side legs respectively pivotally supported on said side legs of said subframe, said side legs extending along said movable contact finger and having a common leg joining said side legs and extending over said movable contact finger forming one arm of said bell crank, said bell crank side legs also extending beyond a lower surface of said movable contact finger forming a second arm of said bell crank, and means at lower ends of said bell crank side leg engaging said movable frame for securing said subframe and said movable frame together.

14. The releasable lock means defined in claim 13 wherein said movable frame comprises an inverted U-shaped member having sides extending along said side legs of said subframe, outer edges of said sides of said movable frame having notches therein, and said means at said lower ends of said bell crank side legs comprise projections extending into said notches.

15. The releasable lock means defined in claim 13 wherein said means at said lower ends of said bell crank side legs comprises a pin extending through holes in said side legs and projecting beyond each side leg for engaging said notches in said movable frame sides, said pin extending under said movable contact finger and driving said finger out of engagement with said stationary contact in response to movement of said operating mechanism to open said circuit breaker.

16. The releasable lock means defined in claim 13 further comprising second spring means affixed to said common leg of said subframe, said second spring means abutting an upper surface of said common leg of said bell crank pawl, biasing said bell crank toward said engagement with said movable frame.

* * * * *